US009481378B2

(12) United States Patent
Lohmann et al.

(10) Patent No.: US 9,481,378 B2
(45) Date of Patent: Nov. 1, 2016

(54) LIGHT STRIP FOR A PASSENGER COMPARTMENT OF A RAIL VEHICLE

(71) Applicant: SIEMENS AKTIENGESELLSCHAFT, Munich (DE)

(72) Inventors: Thomas Lohmann, Wesel (DE); Dirk Rohwerder, Sprockhoevel (DE)

(73) Assignee: Siemens Aktiengesellschaft, Munich (DE)

( * ) Notice: Subject to any disclaimer, the term of this patent is extended or adjusted under 35 U.S.C. 154(b) by 229 days.

(21) Appl. No.: 14/386,826

(22) PCT Filed: Mar. 5, 2013

(86) PCT No.: PCT/EP2013/054353

§ 371 (c)(1),
(2) Date: Sep. 22, 2014

(87) PCT Pub. No.: WO2013/139586

PCT Pub. Date: Sep. 26, 2013

(65) Prior Publication Data

US 2015/0078019 A1 Mar. 19, 2015

(30) Foreign Application Priority Data

Mar. 21, 2012 (DE) ..... 10 2012 204 503

(51) Int. Cl.
*B60Q 3/00* (2006.01)
*F21V 33/00* (2006.01)
*B61D 29/00* (2006.01)

(52) U.S. Cl.
CPC ..... *B61D 29/00* (2013.01)

(58) Field of Classification Search
CPC . B61D 29/00; E04F 2290/026; B63B 45/06; B63B 45/08; F21V 3/00–3/049
See application file for complete search history.

(56) References Cited

U.S. PATENT DOCUMENTS

| | | | | |
|---|---|---|---|---|
| 2,526,828 A | | 10/1950 | Phillips | |
| 2,902,917 A | | 9/1959 | Peterson | |
| 5,457,923 A | * | 10/1995 | Logan | E04F 19/0436 52/272 |
| 5,555,687 A | * | 9/1996 | Logan | E04F 19/0436 52/272 |
| 6,435,697 B1 | * | 8/2002 | Simmons | F21V 17/107 362/219 |
| 6,739,735 B2 | * | 5/2004 | Meyer | E01C 17/00 362/153.1 |
| 2009/0109666 A1 | * | 4/2009 | Striebel | F21V 21/005 362/225 |
| 2015/0204489 A1 | * | 7/2015 | Baello | E04F 19/0463 362/231 |

FOREIGN PATENT DOCUMENTS

| | | |
|---|---|---|
| DE | 1962106 U | 6/1967 |
| DE | 29620797 U1 | 2/1997 |

* cited by examiner

*Primary Examiner* — Mariceli Santiago
(74) *Attorney, Agent, or Firm* — Laurence Greenberg; Werner Stemer; Ralph Locher

(57) ABSTRACT

A light strip, lighting fixture or lamp band for installation in an interior passenger compartment of a rail vehicle includes a plurality of elongate light covers that can be connected to each other in the longitudinal direction thereof to form the light strip. A double-walled intermediate cover is provided between at least two successive light covers in the longitudinal direction of the light strip. The inner wall of the light strip protrudes opposite the outer wall in the longitudinal direction of the light strip so that a gap resulting between the intermediate cover and the adjacent light cover is concealed.

11 Claims, 2 Drawing Sheets

LIGHT STRIP FOR A PASSENGER COMPARTMENT OF A RAIL VEHICLE

BACKGROUND OF THE INVENTION

Field of the Invention

The invention relates to a light strip for installation in a passenger compartment of a rail vehicle, having a plurality of elongate light covers that can be connected to each other in the longitudinal direction thereof to form the light strip.

Such light strips are used frequently in the prior art. Here, reference can be made to the DESIRO Mainline and the DESIRO AM_08 Brussels as an example of a vehicle.

Since car bodies of rail vehicles have certain length tolerances, the installation of light strips is often problematic. This is because the length of light strips cannot be changed or changed only with a great deal of effort, in particular shortened. The length of the fluorescent tubes used in the light strips is decisive here.

In order to solve this problem, light strips often extend into an adjacent contour and are then covered by bezels. If possible, the lamp covers are shortened. However, if the tolerances in the length of the car body move in the positive range, gap dimensions between the individual lamp covers are enlarged.

BRIEF SUMMARY OF THE INVENTION

Starting from this point, the invention is based on the object of developing a light strip of the type mentioned at the beginning in such a way that better account can be taken of length tolerances of car bodies.

This object is achieved in that an intermediate cover of double-walled configuration is provided between at least two light covers following one another in the longitudinal direction of the light strip, wherein the wall located on the inside in relation to the light strip projects with respect to the outer wall in the longitudinal direction of the light strip in such a way that a gap resulting between the intermediate cover and the adjacent light cover is concealed.

The intermediate cover provided makes it possible, by means of the projecting section of the inner wall thereof, to counter length tolerances of the car body in that a distance between an intermediate cover and a light cover that is adjacent thereto is enlarged but a resultant gap between these two components is reliably concealed.

For a beneficial support of the adjacent light cover, the inner wall of the intermediate cover can engage under a wall of the light cover.

Here, the inner wall of the intermediate cover is preferably formed by a spring steel sheet. By contrast, an outer wall of the intermediate cover can be formed by an aluminum sheet.

The intermediate cover can carry an optical/acoustic functional element on the inner side thereof. This can be, for example, a loudspeaker or a light-emitting diode array, the intermediate cover then being equipped with suitably formed openings for the passage of sound or light. The light covers are preferably produced from polycarbonate.

In the longitudinal direction of the light strip, the latter can have a plurality of intermediate covers which are identical to the intermediate cover. As a result of providing a plurality of intermediate covers, overall a greater length tolerance of the car bodies is possible without the concealment of resultant gaps being stopped.

BRIEF DESCRIPTION OF THE SEVERAL VIEWS OF THE DRAWINGS

An exemplary embodiment of the invention will be explained in more detail below with reference to the drawings, in which.

DESCRIPTION OF THE INVENTION

Figure 1:
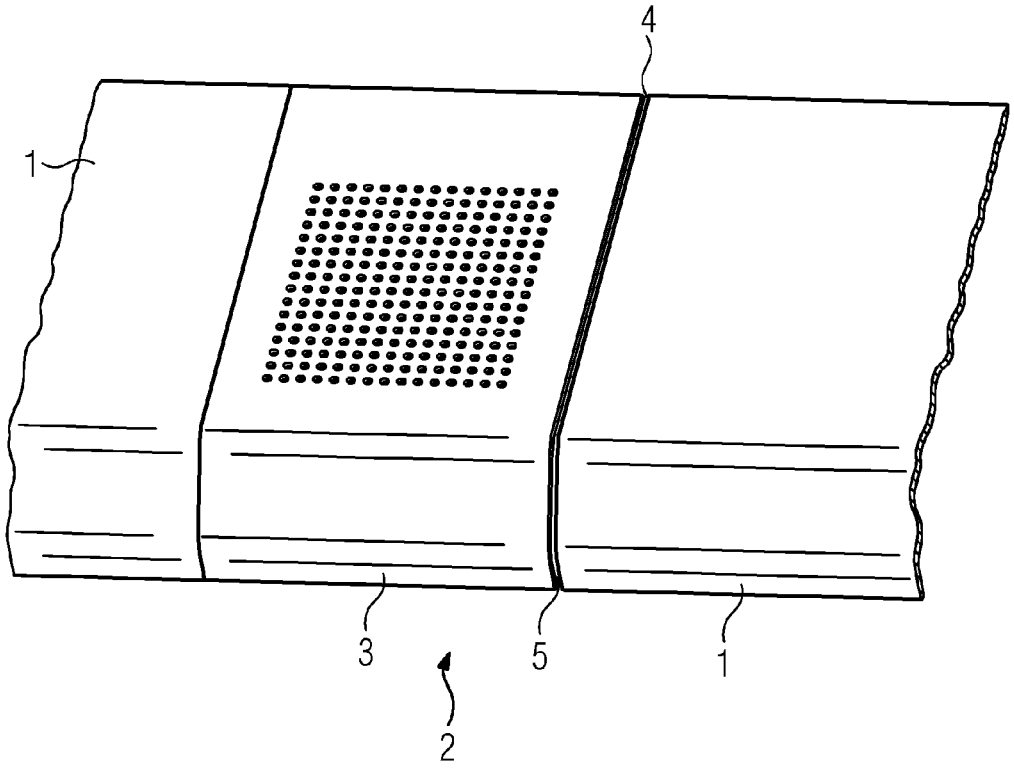
FIG. 1 shows a perspective view of a light strip section.
Figure 2:
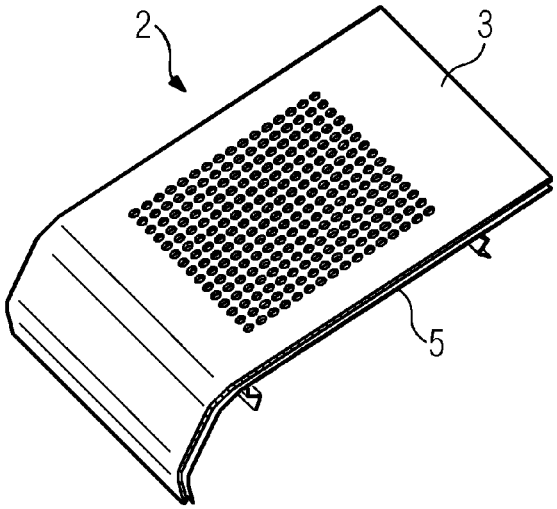
FIG. 2 shows a perspective view of an intermediate cover, which is part of the light strip of FIG. 1.

FIG. 1 shows a section of a light strip for installation in a passenger compartment of a rail vehicle, preferably on an internal ceiling. Between two light covers 1, behind which, for example, fluorescent tubes are arranged, an intermediate cover 2 is provided. In order to compensate for a length tolerance which has to be taken into account when installing the light strip, the intermediate cover 2 immediately adjoins the light cover shown on the left in FIG. 1, while a gap 4 results between an outer wall 3 of the intermediate cover 2 and the light cover 1 shown on the right in FIG. 1.

The gap 4 is concealed by an inner wall 5 of the intermediate cover 2, the inner wall 5 engaging under the wall of the light cover 1.

With regard to the materials used, the following results: the light covers 1 are produced from polycarbonate, the outer wall of the intermediate cover 3 consists of sheet aluminum, while the inner wall 5 is produced from spring steel sheet. In terms of the external coloring, the light covers 1 and the intermediate cover 2, including the inner wall 5, are formed identically, at least in the section that projects with respect to the outer wall 3, so that the result is a uniform appearance of the light strip.

Figure 3:
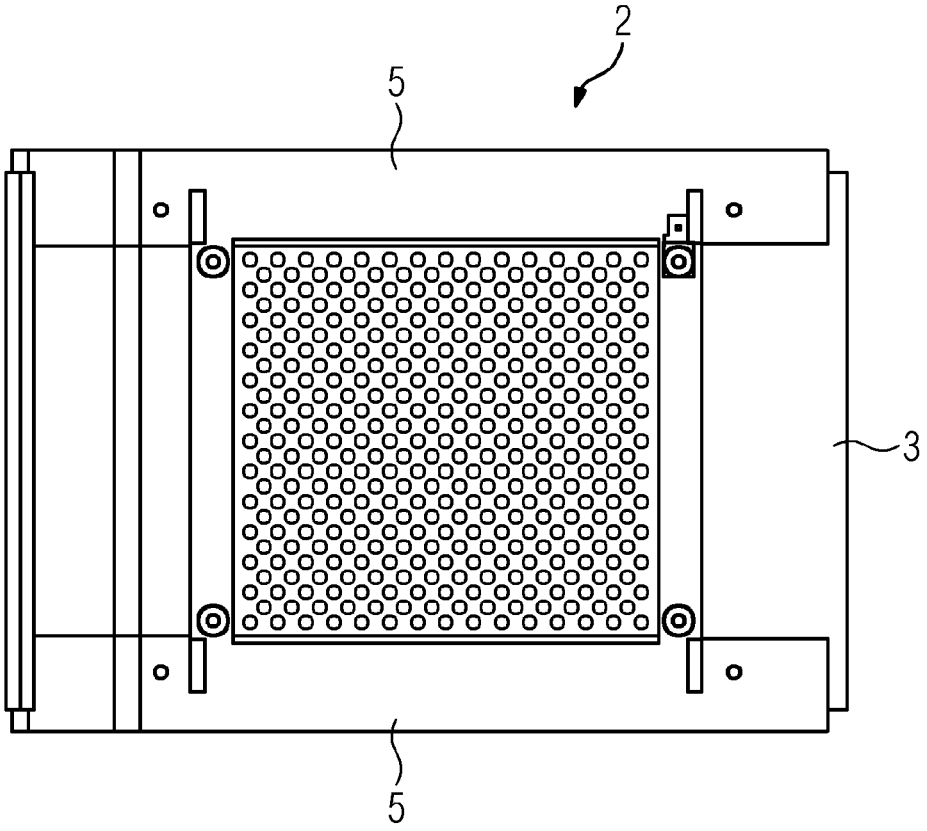
FIG. 3 shows a view from below of the intermediate cover from FIG. 2.

It can be gathered from the illustration of FIG. 3 that the inner wall 5 of the intermediate cover 2 is provided only on those edges of the intermediate cover 2 which are used for the connection to the adjacent light covers 1. FIG. 3 and also FIG. 1 reveal that the outer wall 3 of the intermediate cover 2 is equipped with a surface section which has openings which, for example, can be used for the passage of sound if a loudspeaker is arranged on an inner side of the intermediate cover 2. Alternatively, this surface section can also be formed in such a way that, instead of the loudspeaker, an LED array can be used on the inner side of the intermediate cover 2.

Figure 4:
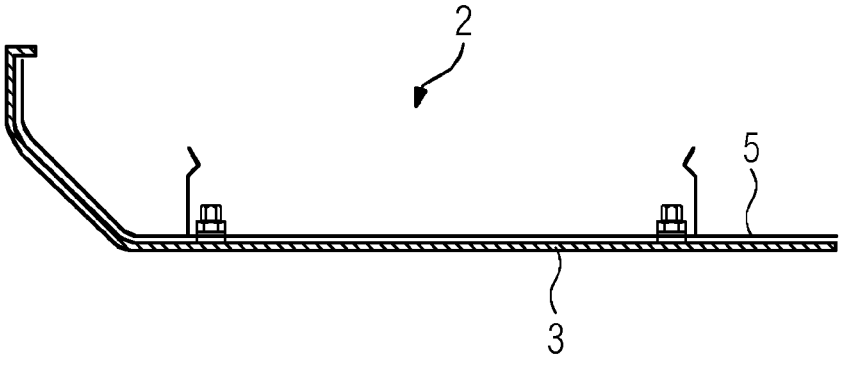
FIG. 4 shows a cross-sectional view of the intermediate cover of FIGS. 2 and 3.

The cross-sectional view of FIG. 4 reveals that the inner wall 5 follows the outer wall 3 over an entire edge region, so that a gap 4 that results is reliably concealed.

In order to compensate for the length tolerances of a car body of a rail vehicle, it is thus possible, in the respective connecting regions between the two light covers 1 and the intermediate cover 2, to provide gaps 4 that are dimensioned in such a way that, overall, the length of the light strip is matched to the installation location. If necessary, it is also possible for a plurality of further intermediate covers structurally identical to the intermediate cover 2 to be provided, which increases the adaptability of the length of the light strip.

The invention claimed is:

1. A light strip for installation in a passenger compartment of a rail vehicle, the light strip comprising:

a plurality of elongate light covers having a longitudinal direction and being configured to be connected to each other in said longitudinal direction to form the light strip;

an intermediate cover having a double-walled configuration with an inner wall and an outer wall, said intermediate cover being disposed between at least two of said light covers following one another in a longitudinal direction of the light strip; and said inner wall projecting relative to said outer wall in said longitudinal direction of the light strip to conceal a gap formed between said intermediate cover and an adjacent one of said light covers.

2. The light strip according to claim 1, wherein said inner wall of said intermediate cover engages under a wall of one of said light covers.

3. The light strip according to claim 1, wherein said inner wall of said intermediate cover is formed by a spring steel sheet.

4. The light strip according to claim 1, wherein said outer wall of said intermediate cover is formed by an aluminum sheet.

5. The light strip according to claim 1, wherein said intermediate cover carries an optical/acoustic functional element on an inner side thereof.

6. The light strip according to claim 5, wherein said functional element is formed by a loudspeaker or a light-emitting diode array.

7. The light strip according to claim 1, wherein said light covers are produced from polycarbonate.

8. The light strip according to claim 1, wherein said intermediate cover is one of a plurality of identical intermediate covers disposed along said longitudinal direction of the light strip.

9. The light strip according to claim 1, wherein said inner wall of said intermediate element projects on both sides relative to said outer wall of said intermediate element, in said longitudinal direction of the light strip.

10. The light strip according to claim 1, wherein said light covers and said intermediate cover have identical coloring.

11. The light strip according to claim 8, wherein said light covers and said intermediate covers have identical coloring.

* * * * *